United States Patent [19]

Rogall et al.

[11] Patent Number: 4,911,285

[45] Date of Patent: Mar. 27, 1990

[54] DRIVE FOR A ROTARY PLATE IN A LABELLING MACHINE FOR BOTTLES

[75] Inventors: Wolfgang Rogall, Wuppertal-Vohwinkel; Wilfried Rübel, Haan; Dieter Thiel, Dortmund; Rudolf Zodrow, Düsseldorf, all of Fed. Rep. of Germany

[73] Assignee: ETI-TEC Maschinenbau GmbH, Erkrath, Fed. Rep. of Germany

[21] Appl. No.: 260,787

[22] Filed: Oct. 21, 1988

[30] Foreign Application Priority Data

Oct. 23, 1987 [DE] Fed. Rep. of Germany ..... 3735882

[51] Int. Cl.[4] ..... B65C 9/04

[52] U.S. Cl. ..... 198/474.1; 198/344; 198/377; 156/567; 156/DIG. 27

[58] Field of Search ..... 198/344, 377, 474.1, 198/475.1, 478.1; 156/567, 571, DIG. 13, DIG. 26, DIG. 27

[56] References Cited

U.S. PATENT DOCUMENTS

| | | | |
|---|---|---|---|
| 4,220,237 | 9/1980 | Mohn | 198/377 |
| 4,275,807 | 6/1981 | Mohn et al. | 198/344 |
| 4,487,650 | 12/1984 | Mohn et al. | 156/567 |

FOREIGN PATENT DOCUMENTS

| | | | |
|---|---|---|---|
| 3323919 | 1/1985 | Fed. Rep. of Germany | 156/567 |

*Primary Examiner*—Robert J. Spar
*Assistant Examiner*—Lyle Kimms
*Attorney, Agent, or Firm*—Nils H. Ljungman

[57] ABSTRACT

A drive shaft is for a rotary plate of a labelling machine for bottles or the like and includes a rotatable turntable of the labelling machine having an upper portion. A circular cam block is mounted below the turntable and has a curved slot therein. The rotary plate is mounted for rotation on the upper portion of the turntable. A drive shaft is mounted for rotation in the turntable and has an upper end and a lower end. The rotary plate is coupled to the upper end of the drive shaft. The lower end of the drive shaft includes a crank arm which is disposed in the curved slot for cammed rotation of the drive shaft during rotation of the turntable. The curved slot includes an opening in the cam block and the drive shaft including the crank arm is alignable with the opening for downward removal from and upward installation in the turntable through the opening. There is also included a feature of the rotary plate being mounted on a base plate which is selectively positionable on the turntable for either direct coupling or geared coupling between the rotary plate and the upper end of the drive shaft.

14 Claims, 2 Drawing Sheets

DRIVE FOR A ROTARY PLATE IN A LABELLING MACHINE FOR BOTTLES

BACKGROUND OF THE INVENTION

1. Field of the Invention

This invention relates to a drive for a rotary plate mounted in a turntable of a labelling machine for bottles or similar items and, more specifically, to such a drive wherein the rotary plate is coupled with a drive shaft mounted in the turntable and rotates when the turntable rotates by means of a crank supported by the drive shaft and guided in a curved slot located under the turntable.

2. Description of the Prior Art

In a prior art labelling machine disclosed in U.S. Pat. No. 4,275,807, the rotary plate, the drive shaft with the crank and a gearing located between the drive shaft and the rotary plate are located in a cylindrical block, which can be installed from the upper side of the turntable. To be able to run other rotation programs, either the housing block is replaced by another housing block with a different speed transforming transmission or the housing block is rotated by 180° in the turntable, whereby the curved slot for clockwise rotation is replaced by a symmetrical curve for counterclockwise rotation. In either case, it is guaranteed that the lever arm will be guided in a sliding manner in the curved slot. Any possible advantages which may reduce the weight of the equipment appear to be offset by the disadvantage of the cylindrical housing block with an included transmission being relatively expensive to manufacture.

OBJECTS OF THE INVENTION

It is an object of the invention to simplify the drive for a rotary plate driven by a crank and mounted in a turntable of a labelling machine for bottles or similar items.

It is another object of the invention to simultaneously include such a drive for a rotary plate having features which facilitate the installation and removal of the various components or alternative components thereof.

SUMMARY OF THE INVENTION

These and other objects of the invention are provided in a preferred embodiment thereof including a drive shaft for a rotary plate of a labelling machine for bottles or the like. The drive includes a rotatable turntable of the labelling machine having an upper portion. A circular cam block is mounted below the turntable and has a curved slot therein. A rotary plate is mounted for rotation on the upper portion of the turntable. A drive shaft is mounted for rotation in the turntable and has an upper end and a lower end. The rotary plate is coupled to the upper end of the drive shaft. The lower end of the drive shaft includes a crank arm which is disposed in the curved slot for cammed rotation of the drive shaft during rotation of the turntable. The curved slot includes an opening in the cam block and the drive shaft including the crank arm thereon is alignable with the opening for downward removal from and upward installation in the turntable through the opening.

The objects of the invention are also provided in another embodiment thereof including a drive for a rotary plate in a labelling machine for bottles or the like which includes a rotatable table of the labelling machine having an upper portion. A circular cam block is mounted below the turntable and has a curved slot therein. A base plate is mounted on the upper portion of the turntable with the rotary plate being mounted for rotation thereon. A drive shaft is mounted for rotation in the turntable and has an upper and a lower end. The lower end of the drive shaft includes a crank arm which is disposed in the curved slot for cammed rotation of the drive shaft during rotation of the turntable. The base plate is selectively positionable on the upper portion of the turntable at at least one of a first position and a second position. The rotary plate can be directly coupled to the upper end of the drive shaft or can be coupled through gearing to the upper end of the drive shaft. The direct coupling of the rotary plate to the upper end of the drive shaft is employed when the base plate is in the first position. The geared coupling between the rotary plate and the upper end of the drive shaft is employed when the base plate is in the second position.

A rotary plate of the type described above is characterized by the fact that the crank having a drive shaft secured thereto is flush or aligned with the curved slot at at least one point of the curved slot. The curved slot includes a downward opening at the one point with the width of the crank and the drive shaft secured thereon being equal to or slightly less than the width of the opening in the curved slot. As a result, the crank drive shaft can be removed toward the underside of the turntable through the opening in the curved slot.

The mounting of the rotary plate and the drive shaft directly in the turntable is not as expensive to manufacture as the mounting in a cylindrical housing block. Additionally, the drive shaft is also easier to install because of the curved slot having an opening in the bottom thereof. As with the prior art device discussed above, a conversion to different rotation programs is possible. The change can be made merely by withdrawing the crank through the opening, turning the crank 180° when it is reinstalled and changing the curved slot from clockwise operation to counterclockwise operation.

In contrast to the prior art device discussed above, the rotary plate and the drive shaft including a crank are mounted independently of one another. Preferably, the rotary plate is installed in a base plate which is mounted on the upper side of the turntable.

If the rotary plate is installed or mounted in a base plate, one configuration of the invention provides for the base plate to have two defined installation positions which are offset from one another by 180°. In one of these positions, the rotary plate is coupled by means of a gearing to the drive shaft. In the other position, the rotary plate is coupled directly with the drive shaft. In such a case, as in the prior art device, it is necessary to adjust the path of the curved slot for the various rotation programs. The complete curved slot need not always be replaced, because, in some instances, it may be sufficient if individual parts are replaced in the area of the processing stations.

As an alternative to the opening in the bottom of the curved slot and to eliminate the need for any adjustment of the width of the crank and the lever arm to the free width in the vicinity of the opening in the curved slot, it is also possible to make a segment or piece of the curved slot removable, so that the crank with the lever arm can be removed from the bottom.

DESCRIPTION OF THE PREFERRED EMBODIMENTS

Figure 1:
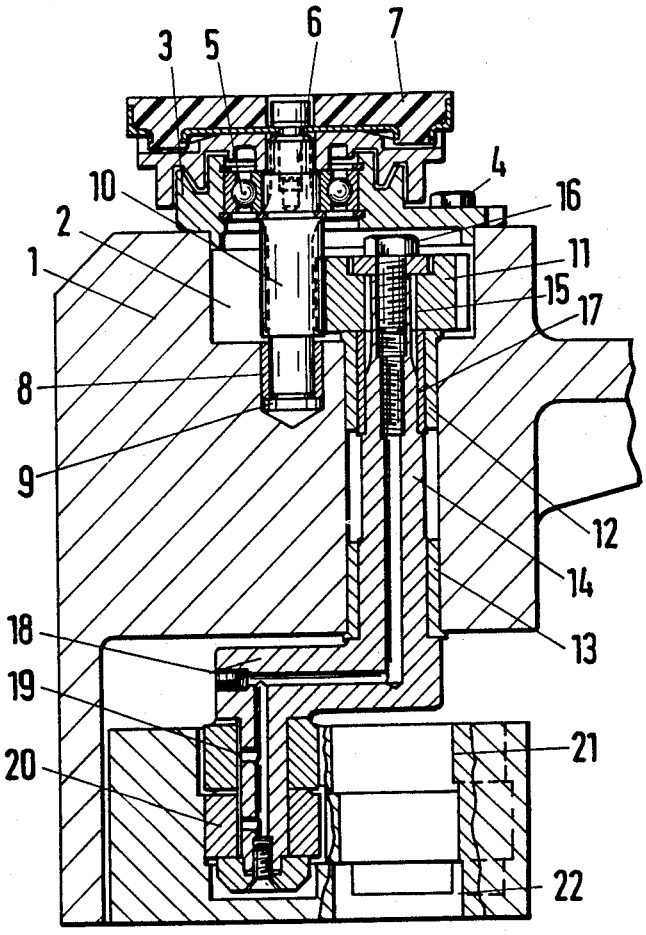
FIG. 1 is a fragmentary, sectional view of the preferred drive mechanism for the rotary plate of a labelling machine.
Figure 2:
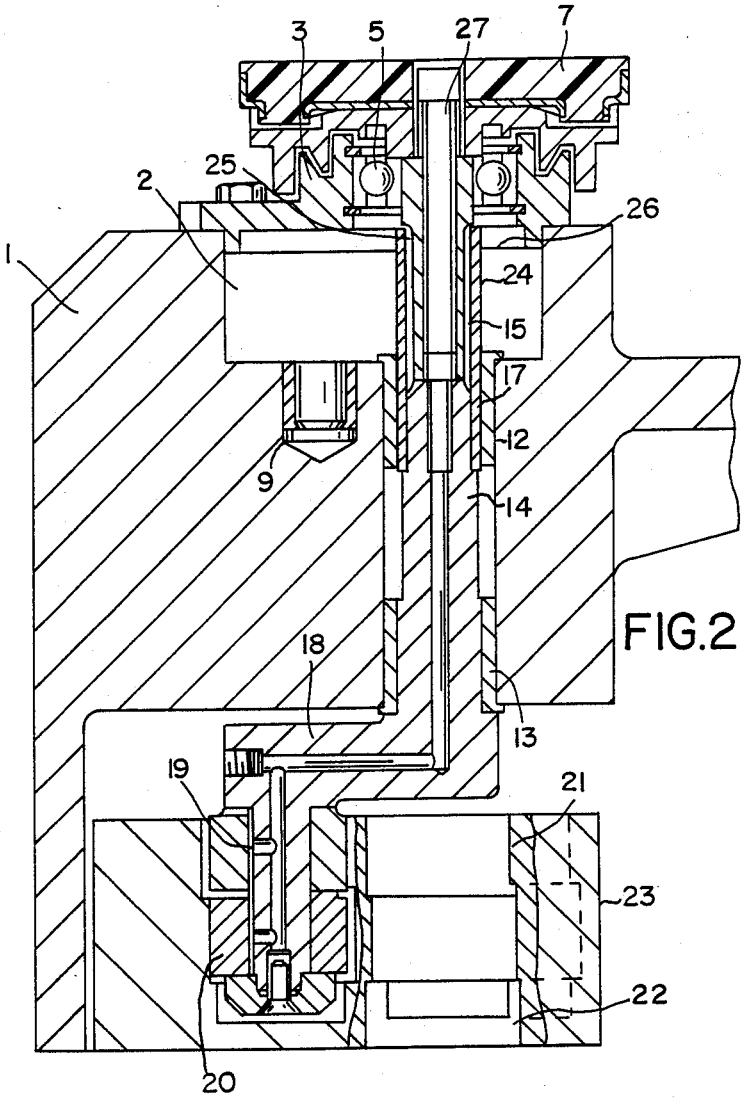
FIG. 2 is a fragmentary, sectional view similar to that of FIG. 1 including an alternative form of the invention.

As seen in FIG. 1, the sectional view of the preferred drive mechanism for the rotary plate of a labelling machine is not taken specifically along a radial section of the labelling machine. The sectional view is instead taken along different intersecting planes to primarily show the position of the components of the drive mechanism and the rotary plate relative to each other rather than their positions relative to the labelling machine as a whole. In other words, the specific location of the drive shaft as discussed hereinbelow is not radially inwardly of the rotary plate but, instead, can be located at a different angle relative to the rotary plate. Similarly, although the sectional view of FIG. 1 appears to include the rotary plate on the radial, outer edge of the base plate, it should be recognized that the radial plate is preferably on a side of the base plate which is circumferentially rather than radially offset. As will be made clear from the description below, the locations of the rotary plate, the base plate and the drive shaft relative to each other are preferably in a circumferential direction. As a result, the preferred rotary plate and the preferred drive shaft are each located at the same radial distance from the center of the turntable in the preferred embodiment of the invention.

As seen in FIG. 1, a turntable 1 of the preferred labelling machine includes one of a plurality of open seats 2 located in the top thereof. The plurality of open seats 2 are in a circular array which is concentric with the axis of rotation. Mounted on each seat 2 is a base plate 3. The base plate 3 is held in position by threaded fasteners 4 and can be installed in either of two positions which are offset from one another by 180°. A rotary plate 7 is installed on a bearing shaft 6 which is mounted in the base plate 3 by means of a ball bearing 5. The bearing shaft 6 is also supported at its lower end by means of a friction bearing 8 in a blind hole of the turntable 1.

Between the two bearings 5, 8 and within the seat 2, the bearing shaft 6 includes a plurality of teeth 10. The plurality of teeth 10 are engaged by a pinion 11 which is mounted on a drive shaft 14 supported by two friction bearings 12, 13 in the turntable 1. The pinion 11 is coupled by a spline 15 to rotate with the drive shaft 14 and is held on the spline 15 by means of an axial threaded fastener 16. A steel sleeve 17 is inserted over the drive shaft 14 and covers the lower region of the spline 15 to effectively extend the supported region in the vicinity of the upper friction bearing 12.

A crank 18 which is integrally formed with the drive shaft 14 is located beneath the turntable 1. The free end of the crank 18 includes a pair of feeler rollers 19, 20 which are respectively mounted on friction bearings. Each of the two feeler rollers 19, 20 respectively interact with one of the opposite, offset sides of a curved slot 21 of a circular cam block 23 which is fixedly mounted below the turntable 1. The rotation of the turntable 1 relative to the cam block 23 and the curved slot 21 thereof produces movement of the feeler rollers 19, 20 to cause rotation of the drive shaft 14. The preferred curved slot 21 includes an opening 22 in the bottom thereof at a location with which the drive shaft 14 and crank 18 can be aligned. The length of this opening 22 is greater than the length of the crank 18. Further, the free width of the opening 22 is equal to at least the width of the crank 18 and the drive shaft 14 including the diameter of the feeler rollers 19, 20 mounted thereon.

In order to be able to release the crank 18 for removal or for repositioning by 180° rotation, the base plate 3 is first removed. The threaded fasteners 4 are loosened and then removed from the top of the base plate 3. The threaded fastener 16 on the drive shaft 14 is accessible after the base plate 3 is removed so that it can be loosened. After the threaded fastener 16 is withdrawn, the crank 18 is positioned in the curved slot 21 above the opening 22 so that the crank 18 together with the pair of feeler rollers 19, 20 and the drive shaft 14 can be removed downwardly through the opening 22 in the curved slot 21. The crank 18 with the drive shaft 14 and the pair of feeler rollers 19, 20 can be withdrawn, pivoted by 180° and reinstalled, or it can be replaced by another drive shaft having a crank and pair of feeler rollers 19, 20.

After removing the base plate 3, however, it is also possible to produce a different speed transmission ratio without changing the crank 18 itself. In this case, the gearing, consisting of the teeth 10 and the toothed wheel 11, is simply replaced by another gearing.

Finally, the invention makes it possible for the rotary plate 7 to be directly coupled to the drive shaft 14 after adjusting the base plate 3 by 180°. In this case, instead of the toothed wheel 11, a sleeve 24 with internal splines is placed on the spline 15 of the drive shaft 14. The sleeve 24 is also coupled by means of the internal splines to a longer bearing shaft 25 at splines 26 about the outer surface thereof. The threaded fastener 16 is replaced by a longer threaded fastener 27 which goes all the way through the bearing shaft 25 as it is supported for rotation. As a result, there is provided axial bracing by the rotary plate 7 for the entire drive shaft 14 as it is supported for rotation in the turntable 1.

Figure 3:
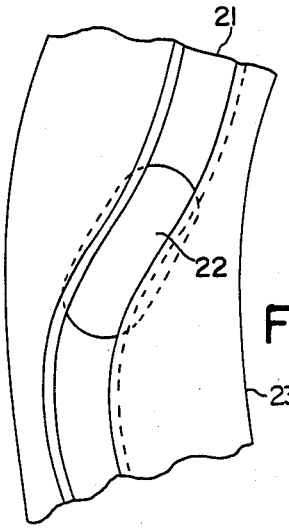
FIG. 3 is a fragmentary, top view of the curve slot configuration of the embodiment shown in FIG. 1.

As seen in FIG. 3, a top view of the curved slot 21 of the cam block 23 includes the opening 22 which is generally elongated. The elongated opening 22 is in a location within the curved slot 21 with which the drive shaft 14 and the crank 18 thereof can be aligned. The overall dimensions of the opening 22 are such that the rollers 19, 20 of the crank 18 and the remainder of the crank shaft 14 can be withdrawn downwardly through the opening 22 when they are properly aligned therewith.

U.S. Pat. Nos. 4,220,237 and 4,456,113 include labelling machines including various elements which are employed for the proper positioning of bottles or the like therein.

In summing up, one aspect of the invention resides broadly in a rotary plate 7 mounted in a turntable 1 of a labelling machine for bottles or similar items, which rotary plate 7 is coupled with a drive shaft 14 mounted in the turntable, and can be rotated when the turntable 1 rotates by means of a crank 18 supported by the drive shaft 14 and guided in a curved slot 21 located under the turntable 1, characterized by the fact that the crank 18 with its drive shaft is flush or aligned with the curved slot 21 at at least one point 22 of the curved slot 21, at which the curved slot 21 is open on the bottom, and the crank 18 with the drive shaft 14 corresponds to the free width of the curved slot 21 at this point 22, and that the crank 18 with its drive shaft 14 can be removed toward the underside of the turntable 1 through the open curved slot 21.

Another aspect of the invention resides broadly in a rotary plate characterized by the fact that the rotary plate 7 is mounted in a base plate 3 mounted on the upper side of the turntable 1.

Yet another aspect of the invention resides broadly in a rotary plate characterized by the fact that the bearing plate 3 has two defined mounting positions, offset from one another by 180°, in one of which positions the rotary plate 7 is coupled by means of a toothed gearing 10, 11, and in the other of which the rotary plate 7 is coupled directly to the drive shaft 14.

The invention as described hereinabove in the context of a preferred embodiment is not to be taken as limited to all of the provided details thereof, since modifications and variations thereof may be made without departing from the spirit and scope of the invention.

What is claimed is:

1. A drive for a rotary plate of a labelling machine for bottles or the like comprising:

a rotatable turntable of said labelling machine having an upper portion;

a circular cam block mounted below said turntable and having a curved slot means therein;

said rotary plate being mounted for rotation on said upper portion of said turntable;

a drive shaft mounted for rotation in said turntable;

said drive shaft having an upper end and a lower end;

means for coupling said rotary plate to said upper end of said drive shaft;

said lower end of said drive shaft including crank arm means for being disposed in said curved slot means for cammed rotation of said drive shaft during rotation of said turntable;

said curved slot means including an opening in said cam block; and said drive shaft including said crank arm means being alignable with said opening for downward removal from and upward installation in said turntable through said opening.

2. The drive according to claim 1, further including a base plate mounted on said upper portion of said turntable wherein said base plate includes means for mounting said rotary plate for rotation thereon.

3. The drive according to claim 1, wherein said drive shaft including said crank arm means is rotatable by 180° to a reversed position after said downward removal and said upward installation in said turntable is in said reversed position.

4. The drive according to claim 3, wherein said crank arm means includes feeler rollers for camming contact with said curved slot means and said drive shaft including said crank arm means and said feeler rollers thereof has outside dimensions which are less than corresponding dimensions of said opening to allow said downward removal and said upward installation of said drive shaft therethrough.

5. The drive according to claim 1, wherein said means for coupling includes a direct coupling device between said rotary plate and said upper end of said drive shaft for axial alignment and corresponding rotation thereof.

6. The drive according to claim 1, wherein said means for coupling includes gearing means between said rotary plate and said upper end of said drive shaft for rotation thereof in opposite directions.

7. The drive according to claim 6, wherein said rotary plate is mounted for rotation on a shaft, said gearing means includes first gear teeth means on said shaft and second gear teeth means on said upper end of said drive shaft and said first gear teeth means and said second gear teeth means are in engagement.

8. The drive according to claim 2, further including a cavity in said upper portion of said turntable, wherein said base plate is mounted over said cavity and said means for coupling is located in said cavity.

9. A drive for a rotary plate in a labelling machine for bottles or the like comprising:

a rotatable turntable of said labelling machine having an upper portion;

a circular cam block mounted below said turntable and having a curved slot means therein;

a base plate mounted on said upper portion of said turntable;

said base plate including means for mounting said rotary plate for rotation thereon;

a drive shaft mounted for rotation in said turntable;

said drive shaft having an upper end and a lower end;

said lower end of said drive shaft including crank arm means for being disposed in said curved slot means for cammed rotation of said drive shaft during rotation of said turntable;

said base plate being selectively positionable on said upper portion of said turntable at at least one of a first position and a second position;

coupling means for coupling said rotary plate to said upper end of said drive shaft including at least one of a direct coupling means and a geared coupling means;

said direct coupling means for coupling said rotary plate to said upper end of said drive shaft when said base plate is in said first position; and said geared coupling means for coupling said rotary plate to said upper end of said drive shaft when said base plate is in said second position.

10. The drive according to claim 9, wherein said rotary plate rotates about a first axis, said drive shaft rotate about a second axis, and said first axis and said second axis are axially aligned when said base plate is in said first position and said direct coupling means is therebetween.

11. The drive according to claim 9, wherein said rotary plate rotate about a first axis, said drive shaft rotates about a second axis, and said first axis and said second axis are parallel and displaced one from the other when said base plate is in said second position and said geared coupling is therebetween.

12. The drive according to claim 9, further including a cavity in said upper portion, wherein said base plate in said first position and in said second position is mounted over said cavity and said coupling means is located in said cavity.

13. The drive according to claim 12, wherein said base plate is selectively positioned between said first position and said second position by 180° rotation relative to said cavity.

14. The drive according to claim 9, wherein said curved slot means includes an opening in said cam block, said drive shaft including said crank arm means is alignable with said opening, and said coupling means includes means for selectively disconnecting and connecting said coupling means and said upper end of said drive shaft to allow said drive shaft to be downwardly removed from and upwardly installed in said turntable through said opening.

* * * * *